US009915137B2

(12) United States Patent
Alekseenko et al.

(10) Patent No.: US 9,915,137 B2
(45) **Date of Patent: *Mar. 13, 2018**

(54) METHOD OF FRACTURING MULTIPLE ZONES WITHIN A WELL USING PROPELLANT PRE-FRACTURING

(71) Applicant: Schlumberger Technology Corporation, Sugar Land, TX (US)

(72) Inventors: Olga Petrovna Alekseenko, Novosibirsk (RU); Alexander F. Zazovsky, Houston, TX (US); Dmitriy Ivanovich Potapenko, Novosibirsk (RU); Christopher N. Fredd, Westfield, NY (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 143 days.

This patent is subject to a terminal disclaimer.

(21) Appl. No.: 14/708,822

(22) Filed: May 11, 2015

(65) Prior Publication Data

US 2015/0240613 A1 Aug. 27, 2015

Related U.S. Application Data

(63) Continuation of application No. 13/198,962, filed on Aug. 5, 2011, now Pat. No. 9,027,641.

(51) Int. Cl.
*E21B 43/26* (2006.01)
*E21B 43/267* (2006.01)
(Continued)

(52) U.S. Cl.
CPC ..... *E21B 43/26* (2013.01); *E21B 43/267* (2013.01); *E21B 33/124* (2013.01); *E21B 43/116* (2013.01); *E21B 43/14* (2013.01)

(58) Field of Classification Search
CPC ..... E21B 43/26; E21B 43/267
See application file for complete search history.

(56) References Cited

U.S. PATENT DOCUMENTS 3,937,283 A 2/1976 Blauer et al.
4,039,030 A 8/1977 Godfrey et al.
(Continued)

FOREIGN PATENT DOCUMENTS

CN 201057037 Y 5/2008
CN 101418681 A 4/2009
(Continued)

OTHER PUBLICATIONS

Kirk, et al., "Encyclopedia of Chemical Technology", Third Edition, Wiley-Interscience, vol. 16, 1981, pp. 248-273.
(Continued)

*Primary Examiner* — Giovanna C. Wright
*Assistant Examiner* — Kristyn A Hall

(57) ABSTRACT

A method of fracturing multiple zones within a wellbore formed in a subterranean formation is carried out by forming flow-through passages in two or more zones within the wellbore that are spaced apart from each other along the wellbore. The flow-through passages are arranged into clusters, where the directions of all flow-through passages, which belong to the same cluster, are aligned within a single plane (cluster plane). At least one cluster of flow-through passages is formed in each zone. The clusters within each zone have characteristics different from those of other zones provided by orienting the cluster planes at different angles relative to principal in-situ stresses and by placing them into different locations along the wellbore in each of the two or more zones. A propellant pre-fracturing treatment is then performed in the two or more zones to create initial fractures (pre-fractures) in each of the two or more zones. The fracturing fluid in the fracturing treatment is provided at a
(Continued)

pressure that is above the pre-fracture propagation pressure of one of the two or more zones to facilitate fracturing of said one of the two or more zones. The pressure of the fracturing fluid is below the pre-fracture propagation pressure of any other non-treated zones of the two or more zones. The isolating of the treated zone is then performed. The fracturing process is then repeated for at least one or more non-treated zones of the two or more zones.

20 Claims, 6 Drawing Sheets

(51) Int. Cl.

| | |
|---|---|
| *E21B 43/14* | (2006.01) |
| *E21B 33/124* | (2006.01) |
| *E21B 43/116* | (2006.01) |

(56) References Cited

U.S. PATENT DOCUMENTS

| | | | |
|---|---|---|---|
| 4,938,286 | A | 7/1990 | Jennings, Jr. |
| 4,974,675 | A | 12/1990 | Austin et al. |
| 5,269,375 | A | 12/1993 | Schroeder |
| 5,287,924 | A | 2/1994 | Burleson et al. |
| 5,295,393 | A | 3/1994 | Thiercelin |
| 5,295,545 | A | 3/1994 | Passamaneck |
| 5,318,123 | A | 6/1994 | Venditto et al. |
| 5,360,066 | A | 11/1994 | Venditto et al. |
| 5,443,119 | A | 8/1995 | Chambers et al. |
| 5,551,344 | A | 9/1996 | Couet et al. |
| 5,964,289 | A | 10/1999 | Hill |
| 6,003,599 | A | 12/1999 | Huber et al. |
| 6,006,838 | A | 12/1999 | Whiteley et al. |
| 6,173,773 | B1 | 1/2001 | Almaguer et al. |
| 6,336,506 | B2 | 1/2002 | Wesson |
| 6,435,277 | B1 | 8/2002 | Qu et al. |
| 6,508,307 | B1 | 1/2003 | Almaguer |
| 6,543,538 | B2 | 4/2003 | Tolman et al. |
| 6,703,352 | B2 | 3/2004 | Dahayanake et al. |
| 6,814,144 | B2 | 11/2004 | Jones |
| 6,907,936 | B2 | 6/2005 | Fehr et al. |
| 7,017,664 | B2 | 3/2006 | Walker et al. |
| 7,051,812 | B2 | 5/2006 | McKee et al. |
| 7,059,411 | B2 | 6/2006 | Hayes |
| 7,066,265 | B2 | 6/2006 | Surjaatmadja |
| 7,108,067 | B2 | 9/2006 | Themig et al. |
| 7,182,138 | B2 | 2/2007 | Behrmann et al. |
| 7,225,869 | B2 | 6/2007 | Willett et al. |
| 7,284,612 | B2 | 10/2007 | Ratanasirigulchai et al. |
| 7,343,975 | B2 | 3/2008 | Surjaatmadja et al. |
| 7,431,075 | B2 | 10/2008 | Brooks et al. |
| 8,234,072 | B2 | 7/2012 | Smith et al. |
| 9,121,272 | B2 | 9/2015 | Potapenko et al. |
| 2004/0144539 | A1 | 7/2004 | Smith et al. |
| 2006/0196667 | A1 | 9/2006 | Alba et al. |
| 2008/0156498 | A1 | 7/2008 | Phi et al. |
| 2008/0210429 | A1 | 9/2008 | McMillin et al. |
| 2009/0166035 | A1 | 7/2009 | Almaguer |
| 2011/0048707 | A1 | 3/2011 | Kalman et al. |
| 2013/0140020 | A1 | 6/2013 | Suarez-Rivera et al. |

FOREIGN PATENT DOCUMENTS

| | | | |
|---|---|---|---|
| RU | 2401943 | C1 | 10/2010 |
| RU | 2208140 | C1 | 7/2013 |
| WO | 2009001256 | | 12/2008 |

OTHER PUBLICATIONS

C.M. Sayers, et al., "Calibrating the Mechanical Properties and In-Situ Stresses Using Acoustic Radial Profiles", SPE Technical Conference and Exhibition, California, Nov. 11-14, 2007, SPE 110089, pp. 1-8.

J. E. Olson, "Fracturing from Highly Deviated and Horizontal Wells: Numerical Analysis of Non-planar Fracture Propagation", SPE Rocky Mountain Regional/Low-Permeability Reservoirs Symposium, Denver, Mar. 20-22, 1995, SPE 29573, pp. 275-287.

M.W. Alberty, M.R. McLean, "A Physical Model for Stress Cages," SPE Annual Technical Conference and Exhibition, Sep. 26-29, 2004, SPE 90493, pp. 1-8.

G.S. De, et al, "Predicting Natural or Induced Fracture Azimuths From Shear-Wave Anisotropy," SPE Reservoir & Engineering, Aug. 1998, pp. 311-318.

P. Armstrong, et al, "The Promise of Elastic Anisotropy," Oilfield Review, Oct. 1994, pp. 36-47.

Behrmann et al., "Effect of Perforations on Fracture Initiation," Journal of Petroleum Technology, May 1991, pp. 608-615, Society of Petroleum Engineers.

Cherny et al., "2D Modeling of Hydraulic Fracture Initiating at a Wellbore with or without Microannulus," SPE 2 119352, Jan. 19-21, 2009, 2009 SPE Hydraulic Fracturing Technology Conference, The Woodlands, Texas, 23 pages total, Society of Petroleum Engineers.

Glasbergen et al., "Design and Field Testing of a Truly Novel Diverting Agent," SPE 102606, Sep. 24-27, 2006, 2006 SPE Annual Technical Conference and Exhibition, San Antonio, Texas, 20 pages total, Society of Petroleum Engineers.

Harrison, N.W., "Diverting Agents—History and Application," SPE 3653, May 1972, Journal of Petroleum Technology, presented at SPE Illinois Basin Regional Meeting, Evansville, Ind., Nov. 18-19, 1971, pp. 593-598, 1971, American Institute of Mining, Metallurgical, and Petroleum Engineers, Inc.

Hewett et al., "Induced Stress Diversion: A Novel Approach to Fracturing Multiple Pay Sands of the NBU Field, Uintah Co., Utah," SPE 39945, Apr. 5-8, 1998, 1998 SPE Rocky Mountain Regional/Low Permeability Reservoirs Symposium and Exhibition, Denver, Colorado, pp. 375-383, Society of Petroleum Engineers.

Hossain et al., "A Comprehensive Monograph for Hydraulic Fracture Initiation From Deviated Wellbores Under Arbitrary Stress Regimes," SPE 54360, Apr. 20-22, 1999, 1999 SPE Asia Pacific Oil and Gas Conference and Exhibition, Jakarta, Indonesia, 11 pages total, Society of Petroleum Engineers.

Potapenko et al., "Barnett Shale Refracture Stimulations Using a Novel Diversion Technique," SPE 119636, Jan. 19-21, 2009, 2009 SPE Hydraulic Fracturing Technology Conference, The Woodlands, Texas, 11 pages total, Society of Petroleum Engineers.

Van De Ketterij, R.G., "Optimisation of the Near-Wellbore Geometry of Hydraulic Fractures Propagating from Cased Perforated Completions," 2001, Delft University Press, Delft, Netherlands.

Waters et al., "Use of horizontal well image tools to optimize Barnett Shale reservoir exploitation", SPE 103202, 2006 SPE Annual Technical Conference and Exhibition, Sep. 24-27, 2006, 13 pages.

Abass et al., "Oriented perforations—a rock mechanics view", SPE 28555, 1994 SPE Annual Technical Meeting, Sep. 25-26, 1994, pp. 411-425.

McDaniel et al., "Gas or Oil Producer? Layered? Laminated?—Basic Guiding Principles We Should Understand for Effective Fracture Stimulation", SPE 118348, 2008 SPE Eastern Regional/AAPG Eastern Section Joint Meeting, Oct. 11-15, 2008, 13 pages.

Cramer, "Stimulating Unconventional Reservoirs: Lessons Learned, Successful Practices, Areas for Improvement", SPE 114172, 2008 SPE Unconventional Reservoirs Conference, Feb. 10-12, 2008, 19 pages.

Ketter et al., "A Field Study Optimizing Completion Strategies for Fracture Initiation in Barnett Shale Horizontal Wells", SPE 103232, 2006 SPE Annual Technical Conference and Exhibition, Sep. 24-27, 2006, 6 pages.

Luke et al., "Test Method to Optimize Acid-Soluble Cement for Unconventional Gas Completions", SPE 114759, CIPC/SPE Gas Technology Symposium 2008 Joint Conference, Jun. 16-19, 2008, 11 pages.

Salimov et al., "Hydraulic Fracturing of Carbonated Formations", Oilfield Industry, Moscow, 2013, pp. 328-332.

Decision on Grant for Russian Application issued in RU 2014108321 dated May 21, 2015; 14 pages (with English ranslation).

(56) References Cited

OTHER PUBLICATIONS

International Search Report and Written Opinion issued in PCT patent appl. No. PCT/US2012/048744 dated Feb. 19, 2013; 9 pages.
Office Action issued in Chinese Patent Application No. 201280049187.3 dated Sep. 1, 2015; 9 pages (with English translation).

METHOD OF FRACTURING MULTIPLE ZONES WITHIN A WELL USING PROPELLANT PRE-FRACTURING

This application claims priority as a continuation application of U.S. pat. application ser. No. 13/198,962, filed Aug. 5, 2011, with the same title. The application is incorporated by reference herein.

BACKGROUND

The statements in this section merely provide background information related to the present disclosure and may not constitute prior art.

Wellbore treatment methods often are used to increase hydrocarbon production by using a treatment fluid to affect a subterranean formation in a manner that increases oil or gas flow from the formation to the wellbore for removal to the surface. Major types of such treatments include fracturing operations, high-rate matrix treatments and acid fracturing, matrix acidizing and injection of chelating agents. Hydraulic fracturing involves injecting fluids into a subterranean formation at pressures sufficient to form fractures in the formation, with the fractures increasing flow from the formation to the wellbore. In chemical stimulation, flow capacity is improved by using chemicals to alter formation properties, such as increasing effective permeability by dissolving materials in or etching the subterranean formation. A wellbore may be an open hole or a cased hole where a metal pipe (casing) is placed into the drilled hole and often cemented in place. In a cased wellbore, the casing (and cement if present) typically is perforated in specified locations to allow hydrocarbon flow into the wellbore or to permit treatment fluids to flow from the wellbore to the formation.

To access hydrocarbon effectively and efficiently, it may be desirable to direct the treatment fluid to multiple target zones of interest in a subterranean formation. There may be target zones of interest within various subterranean formations or multiple layers within a particular formation that are preferred for treatment. In prior art methods of hydraulic fracturing treatments, multiple target zones were typically treated by treating one zone within the well at time. These methods usually involved multiple steps of running a perforating gun down the wellbore to the target zone, perforating the target zone, removing the perforating gun, treating the target zone with a hydraulic fracturing fluid, and then isolating the perforated target zone. This process is then subsequently repeated for all the target zones of interest until all the target zones are treated. As can be appreciated, such methods of treating multiple zones can be highly involved, time consuming and costly.

Accordingly, methods of treating multiple zones within a subterranean formation are desired that overcome these shortcomings.

SUMMARY

A method of fracturing multiple zones within a wellbore formed in a subterranean formation is carried out by performing the steps (a) through (f). In step (a), flow-through passages are formed in two or more zones within the wellbore that are spaced apart from each other along the wellbore. The flow-through passages are arranged into clusters where the directions of all flow-through passages, which belong to the same cluster, are aligned within a single plane (cluster plane). At least one cluster of flow-through passages is formed in each zone. The clusters of flow-through passages within each zone have characteristics different from those of other zones provided by exposing the clusters of flow-through passages to principal in-situ stresses at different angles relative to these stresses and locations along the wellbore in each of the two or more zones to provide differences in stresses, which act perpendicular to clusters planes, within each of the two or more zones.

In (b), a propellant pre-fracturing treatment is performed in the two or more zones to create initial fractures (pre-fractures) in each of the two or more zones, which contain the flow-through passages and in (c) a fracturing fluid is introduced into the wellbore in a fracturing treatment. In step (d) a pressure of the fracturing fluid in the fracturing treatment is provided that is above the pre-fracture propagation pressure of one of the two or more zones to facilitate fracturing of said one of the two or more zones. The pressure of the fracturing fluid in (d) is below the pre-fracture propagation pressure of any other non-fractured zones of the two or more zones. In step (e) isolating a zone fractured according to (d) is performed if there is at least one non-treated zone left. Step (f) requires repeating steps (d) and (e) for at least one or more non-fractured zones of the two or more zones.

Clusters formed within each of two or more zones according to (a) are oriented relative to a selected direction or placed in different locations along the wellbore so that the stress that acts perpendicular to the planes of clusters within the fractured zone of (d) is less than the stress that acts perpendicular to the planes of clusters of any other non-fractured zones of the two or more zones.

In certain embodiments, the difference of stresses that act perpendicular to the planes of clusters may be provided by orienting the planes of clusters at different angles relative to a selected direction. The selected direction may be aligned with or in a plane parallel to a direction of maximum principle in-situ stress of the formation surrounding the wellbore.

In certain embodiments, the difference of stresses that act perpendicular to the planes of clusters is provided by the difference in the magnitude of principal stresses of the formation surrounding the wellbore between different zones of the two or more zones.

In certain embodiments, a plane of a cluster that is formed in (a) may be parallel to the wellbore axis direction in the area of perforation cluster location. The appropriate perforating strategy for forming such a cluster may be perforating with using 0° or 180° phasing with the density of 4 shots per foot or more.

In certain embodiments, a plane of a cluster that is formed in (a) may be directed at the angle between 0° and 90° relative to the wellbore axis direction in the area of perforation cluster location. The appropriate perforating strategy for forming such a cluster may be perforating a very short interval less than 0.5 m using phasing with the angle more than 0° and less than 30°.

The flow-through passages formed according to (a) may be formed by at least one of a perforating gun, by jetting and by forming holes in a casing of the wellbore.

In some applications, the clusters formed within each of two or more zones according to (a) are oriented relative to a selected direction or placed in different locations along the wellbore so that the stress that acts perpendicular to the plane of the cluster is different by 100 psi or more from the stress that acts perpendicular to the plane of cluster of flow-through passages of any other of the two or more zones.

In certain embodiments, the two or more zones may be located in a portion of the wellbore that is substantially vertical. In other embodiments, the two or more zones are located in a portion of the wellbore that is curved. In some embodiments, the two or more zones are located in a portion of the wellbore that is deviated from vertical. And in other embodiments the two or more zones may be located in a portion of the wellbore that is substantially horizontal.

The zone fractured according to (d) may be located towards a toe position of the wellbore and the zone fractured according to (e) may be located towards a heel position of the wellbore in certain embodiments. In other embodiments, the zone fractured according to step (d) may be located towards a heel position of the wellbore and the zone fractured according to step (e) may be located towards a toe position of the wellbore.

In some applications, the fracturing fluid may contain a proppant. The concentration of the proppant in the fracturing fluid may be increased towards the end the fracturing treatment performed in (d) for at least one of the two or more zones.

The fracturing fluid of the fracturing treatment may be selected from at least one of a hydraulic fracturing fluid, a reactive fracturing fluid and a slick-water fracturing fluid. The fracturing fluid may also contain at least one of proppant, fine particles, fibers, fluid loss additives, gelling agents and friction reducing agents in certain applications.

In certain embodiments, the isolation according to (e) prior to (f) may be realized as an incremental pressure buildup (a stress cage) provided by fracture closure on proppant placed inside it within fracturing operation with subsequent interruption of pumping or reduction of pumping rate. In certain instances, the isolation of previously fractured zones may be achieved by the use of at least one of mechanical tools, ball sealers, packers, bridge plugs, flow-through bridge plugs, sand plugs, fibers, particulate material, viscous fluid, foams, and combinations of these. A degradable material may be used for isolating the fractured zone in various applications.

In certain embodiments, the fracturing may be carried out while being monitored.

Each zone may have from 1 to 10 flow-through-passage clusters in some embodiments. In certain instances, each flow-through-passage cluster may have a length of from 0.1 to 200 meters.

The pressure pulse for forming pre-fractures fractures in each of the two or more zones, which contain the clusters of flow-through passages, according to step (b) may be generated by the use of at least one of burning of non-detonable propellant, slow burning of gunpowder charges, shock wave generators, and combinations of these. The pressure pulse is sufficient for forming at least one pre-fracture of the length of 5 wellbore diameters or more in each zone of the two or more zones.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1A:
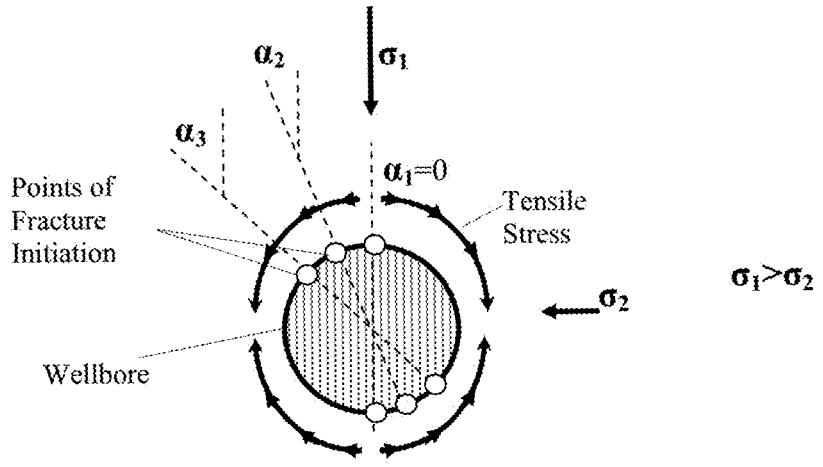
FIG. 1A is a schematic representation of a cross section of a wellbore showing different stresses surrounding the wellbore and the angle (a) of perforations formed in the wellbore relative to these stresses.

The following description and examples are presented solely for the purpose of illustrating the different embodiments of the invention and should not be construed as a limitation to the scope and applicability of the invention. While any compositions of the present invention may be described herein as comprising certain materials, it should be understood that the composition could optionally comprise two or more chemically different materials. In addition, the composition can also comprise some components other than the ones already cited. While the invention may be described in terms of treatment of vertical wells, it is equally applicable to wells of any orientation. The invention will be described for hydrocarbon production wells, but it is to be understood that the invention may be used for wells for production of other fluids, such as water or carbon dioxide, or, for example, for injection or storage wells. It should also be understood that throughout this specification, when a concentration or amount range is described as being useful, or suitable, or the like, it is intended that any and every concentration or amount within the range, including the end points, is to be considered as having been stated. Furthermore, each numerical value should be read once as modified by the term "about" (unless already expressly so modified) and then read again as not to be so modified unless otherwise stated in context. For example, "a range of from 1 to 10" is to be read as indicating each and every possible number along the continuum between about 1 and about 10. In other words, when a certain range is expressed, even if only a few specific data points are explicitly identified or referred to within the range, or even when no data points are referred to within the range, it is to be understood that the inventors appreciate and understand that any and all data points within the range are to be considered to have been specified, and that the inventors have possession of the entire range and all points within the range.

The present invention is directed toward the creation of fractures in multiple zones of a subterranean formation during a fracturing treatment. The method may be used for cased and uncased (open hole) well sections. As described herein, the fracturing treatment is carried out as a single pumping operation and is distinguished from multiple fracturing treatments that may be used to treat different or multiple zones in a formation. As used herein, the expression "single pumping operation" is meant to encompass the situation where pumping of a fracturing fluid has commenced but no further perforation equipment (or other equipment) for forming openings in the wellbore or subjecting previously created openings to wellbore fluid that is reintroduced into the wellbore or moved to another position to facilitate fracturing treatments after the fracturing fluid has been introduced. In the single pumping operation, pumping rates, pressures, and the character and makeup of the fluids pumped may be varied and the pumping may even be halted temporarily and resumed to perform the fracturing treatment. As used herein, this would still constitute a single pumping operation or fracturing treatment. Additionally, in certain applications, the single pumping operation may be conducted while the original perforation equipment is still present in the wellbore.

To accomplish the staged treating of several zones in a well during a single fracturing treatment or pumping operation, differences in conditions of fracture initiation between different wellbore zones are utilized. The differences in conditions of fracture initiation for the different zones are created by means of specifically arranged flow-through passages or perforations formed in the wellbore combined with pressure pulse (propellant) pre-fracturing treatment. As used herein, "flow-through passages" or similar expressions are meant to encompass passages formed in the casing and/or wellbore. Commonly, the flow-through passages may be formed by perforating guns that are lowered into the wellbore and that perforate the casing and/or wellbore. As such, the flow-through passages may be referred to as "perforation(s)" and the expressions "flow-through passage(s)," "perforation(s)," "perforation channel(s)," "perforation tunnel(s)" and similar expressions may be used herein interchangeably unless expressly indicated or is otherwise apparent from its context. Additionally, while flow-through passages may be formed by employing a perforating gun, other methods of forming the flow-through passages may also be used. These may include jetting, cutting, sawing, drilling, filing and the like. In certain embodiments, the flow-through passages may be formed in the casing at the surface or outside of the wellbore, such as described in International Publication No. WO2009/001256A2, which is herein incorporated by reference in its entirety for all purposes. The flow-through passages may also have different sizes, shapes and configurations. Examples, of certain transverse cross-sectional shapes include circular, oval, rectangular, polygonal, half circles, slots and combinations of these and other shapes. In certain embodiments, the cross-sectional length or axis of greatest dimension may be oriented parallel or non-parallel to the longitudinal axis of the casing or wellbore. The diameter or transverse cross dimension of the flow-through passages or perforations may range from 2 to 40 mm. In certain embodiments, the flow-through passages may have a length of from 0.005 to 3 meters.

In the present invention, perforations or flow-through passages are arranged in clusters. The directions of all flow-through passages, which belong to the same cluster, are aligned within one cross-section plane, which can be orthogonal, at an angle or in parallel with the wellbore axis. These cross-section planes are further referred to as perforations planes, planes of clusters and so on. At least one cluster of perforations or flow-through passages should be created within each zone to be treated.

After the clusters of perforations in all zones are created the pressure pulse (propellant) treatment is performed to create multiple initial (of a few meters long) fractures prior to the main treatment. These initial fractures are also referred to as pre-fractures herein. The purpose of the propellant pre-treatment is to replace the creation of fractures from perforations during the main treatment (breakdown of perforations) by forcing the pre-fractures to propagate. The usage of propellant treatment enables creating pre-fractures in a dynamic mode, i.e. overcoming the fracture initiation and orientation constraints dictated by static stresses. So the initial fractures created in a dynamic mode are usually directed along the axes of perforation channels. If we have a cluster of several closely located perforations with the same orientation relative to the principal remote in-situ stresses then the initial fracture will be created within the plane containing the axes of these perforation channels, which is referred to as the pre-fracture plane herein.

By orienting the clusters of flow-through passages or perforations in the different zones being treated so that the stresses that act perpendicular to the cluster planes are different, heterogeneity in pre-fracture propagation pressure (PFPP), which is in essence a pressure of a new hydraulic fracture creation, can be achieved between the zones. A fracturing fluid is then introduced into the wellbore at a pressure above the PFPP of one of the perforated zones to facilitate fracturing of the zone. After that isolating all the fractures within the zone, which has been treated is performed if there is at least one non-treated zone left.

In the next stage of the fracturing treatment, the fracturing pressure is then increased above the fracturing pressure of the next perforated zone to facilitate fracturing of the next zone. This may be repeated until all the zones have been fractured. In the present invention, a propellant pre-fracturing treatment is utilized in combination with the appropriate flow-through channel or perforation arrangement strategy. In the propellant treatment, controlled pulses of high pressure are induced inside the wellbore that are able to create multiple fractures around the wellbore having lengths from a fraction of a meter to a few meters. Propellant treatments include but are not limited to burning of non-detonable propellant, slow burning of gunpowder charges, shock wave generators, etc.

Propellant fracturing is a stimulation technique that uses the high pressure created by gases generated by burning propellants for creating short (up to a few meters long) fractures in the direction of the flow-through passages or perforation channels in the near wellbore region. After the propellant fracturing, these propellant pre-fractures may be closed completely or they can remain partially opened due to the roughness of the fracture surfaces and shear displacement occurring during the treatment after the pressure is reduced.

The method may be utilized in the creation of multiple fractures within the same formation layer or in the creation of multiple fractures in a multi-layered formation, and can be applied to vertical, horizontal and deviated wells. The method may be combined with limited entry fracturing techniques to facilitate further diversion of fluids in several zones at a given injection rate.

Figure 1B:
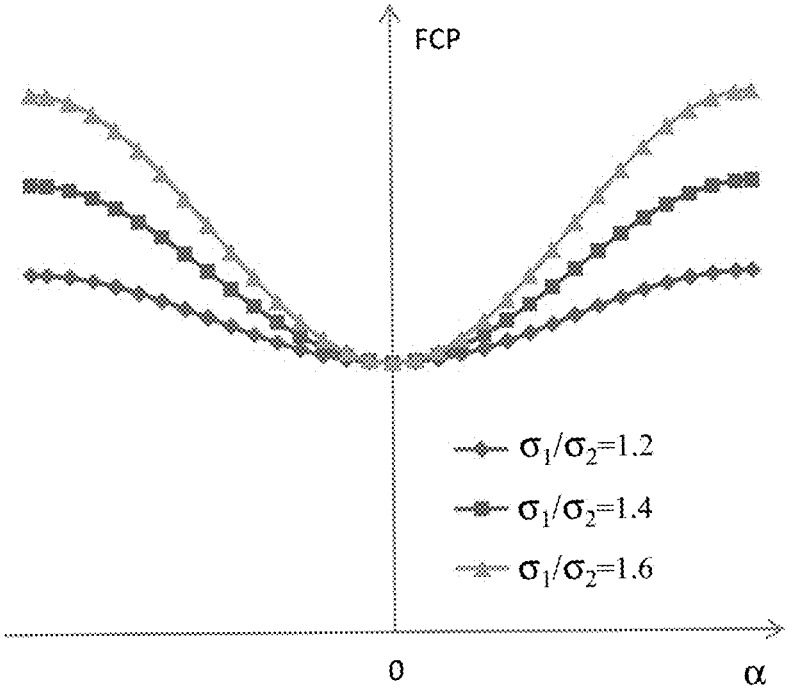
FIG. 1B is a plot of the angle (a) of perforations relative to a direction of a maximum principal stress of the wellbore and the fracture closure pressure (FCP) for different ratios of maximum principal stress to minimum principal stress.

In carrying out the multi-stage fracturing treatment, the wellbore is perforated using an appropriate perforation strategy. The perforation strategy can vary for different types of wells. For vertical, horizontal or deviated from vertical wellbore (or part of the wellbore intended for multi-stage treatment) with straight or slightly curved trajectory the appropriate perforation strategy may utilize 0° or approximately 180° charge phasing and forming perforation clusters in each zone that are rotated at some angle relative to the planes of perforation clusters in all other zones. The orientations of the perforations formed in each zone are based upon differences between the principle stresses in a formation to provide differences in the stresses that act perpendicular to clusters planes, which is referred to as fracture closure pressure (FCP) herein, around the wellbore and therefore differences in pre-fracture propagation pressure (PFPP). For instance, in vertical wells with anisotropy between horizontal stresses an increase of the angle between the plane of the propellant pre-fracture and the direction of maximum horizontal stress causes the corresponding increase in pressure required for further propagation of this pre-fracture. The differences in the horizontal stresses in vertical wells results in the dependence of the FCP and PFPP on the direction of perforation channel To further illustrate this, reference is made to FIGS. 1A and 1B, which shows a transverse cross section of a wellbore with various stresses shown around the wellbore. In FIG. 1A, the fracture closure pressure is minimal when the perforation tunnel is aligned with the direction of the maximum principal stress or in a plane that is parallel to the direction of maximum principal stress (i.e. maximum principal stress=$\sigma_1$ in FIGS. 1A and 1B). The angle (a) of deviation of the perforation tunnel from the direction of maximum principal stress causes an increase in the fracture closure pressure (FCP), as illustrated in FIG. 1B for different ratios of maximum principal stress to minimum principal stress.

In horizontal wells the difference of fracture closure pressures from differently aligned perforation channels is created by the difference between the overburden stress and a combination of horizontal stresses ($\sigma_{horizontal\ min}$; $\sigma_{horizontal\ max}$). Such combination of stresses depends on the orientation of the lateral section in the formation and turns toward $\sigma_{horizontal\ min}$ and a $\sigma_{horizontal\ max}$ when the horizontal section is drilled in the direction of the maximum and minimum horizontal stress, correspondingly. Typically, in horizontal wells, the overburden or vertical stress is the greatest stress (i.e. overburden stress=$\sigma_1$ in FIGS. 1A and 1B).

The tools and techniques for measuring stress anisotropy are well known in the art. The approaches and practical cases have been discussed, for instance, in Oilfield Review, October 1994, pp. 37-47, "The Promise of Elastic Anisotropy". Sonic logs in combination with other logs can identify anisotropic rocks (e.g., deep shale). The physics used for this kind of analysis is based on the phenomena that compression waves travel faster in the direction of applied stress. There are two requirements for anisotropy—alignment in preferential direction and the scale smaller than that of measurement (here—the wavelength). Thus, sonic anisotropy (heterogeneity in the rock) can be measured using ultrasound (small scale), sonic waves (mid scale) and seismic (large scale).

In the simplest cases, two types of alignment (horizontal and vertical) can be considered, which produce two types of anisotropy. In the simplest horizontal case, elastic properties vary vertically but not in layers. This type of rock is called transversely isotropic with the vertical axis of symmetry (TIV). The alternative case of horizontal axis of symmetry is TIH. Both cases of anisotropy may be determined with DSI Dipole Shear Sonic Imager™ tool, available from Schlumberger Technology Corp., Sugar Land, Tex. The DSI tool fires shear sonic pulses alternatively from two perpendicular transmitters to an array of similarly orientated receivers, and the pulse splits into polarization. At this scale of measurement (about borehole size) the most common evidence for TIV layering anisotropy comes from different P-waves velocities measured in vertical and highly deviated (or horizontal) wells. The same technique is applied for processing of S-waves (log presents Slow shear and Fast shear curves). Field examples of using information about velocity (elastic) anisotropy is presented in SPE 110098-MS (Calibrating the Mechanical Properties and In-Situ Stresses Using Acoustic Radial Profiles) and SPE 50993-PA (Predicting Natural or Induced Fracture Azimuths From Shear-Wave Anisotropy).

In deviated wellbores the effect of perforation orientation on fracture closure pressure is more complex and depends on anisotropy between all three principle stresses. Predicting the fracture closure pressure in this situation is still based on calculating the stress field around the wellbore in the perforated region, which also requires knowledge about the wellbore orientation in that zone. A comprehensive monograph for hydraulic fracture initiation from deviated wellbores under arbitrary stress regimes is presented in Hossain et al., SPE 54360 (1999), which is incorporated herein by reference.

In a wellbore or part of a wellbore intended for multi-stage treatment with a strongly curved trajectory, the appropriate perforation strategy can utilize phasing of perforating equipment that is less than 30° and forming short perforation intervals in each zone with the length of perforation interval being less than 0.5 meters. In particular, forming all perforations within one cross-section that is orthogonal to the wellbore axis may be utilized. In combination with subsequent propellant treatments, such a perforation strategy forms propellant pre-fractures in a plane that is orthogonal or almost orthogonal to the wellbore axis.

Figure 4A:
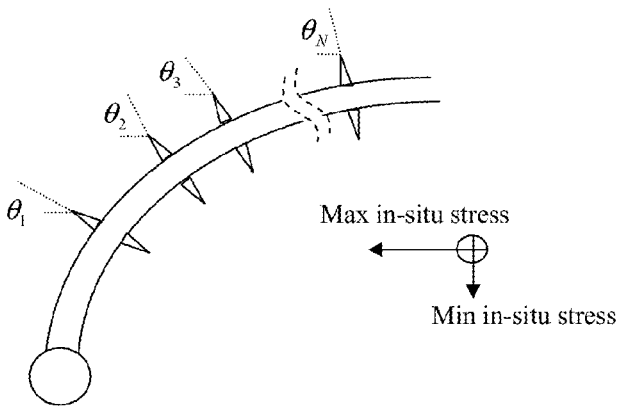
FIG. 4A is a schematic representation of a top view of a horizontal well with a curved trajectory showing perforations oriented at different angles (0) relative to maximum and minimum principal horizontal in-situ stresses.
Figure 4B:
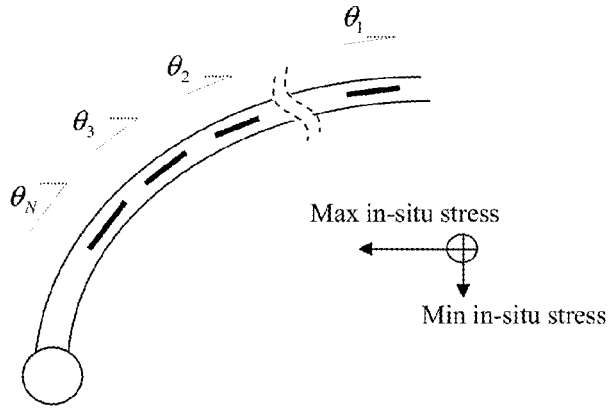
FIG. 4B is a schematic representation of a top view of a horizontal well with a curved trajectory showing clusters of perforations located along the wellbore axis and oriented in the vertical direction.
Figure 4C:
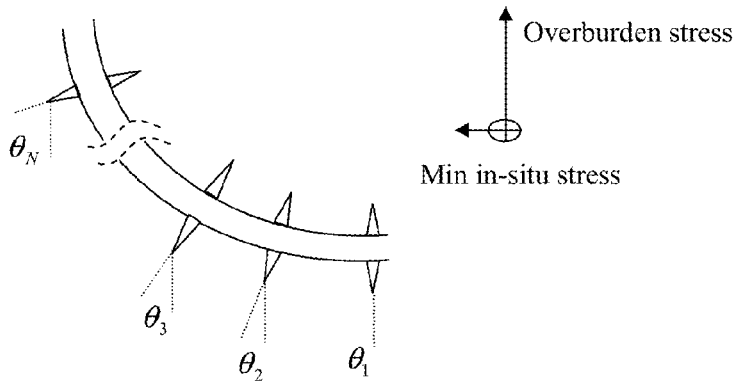
FIG. 4C is a schematic representation of a side view of a deviated wellbore with a trajectory curved in vertical plane showing perforations oriented at different angles (0) relative to overburden (maximum principal in-situ) stress.
Figure 4D:
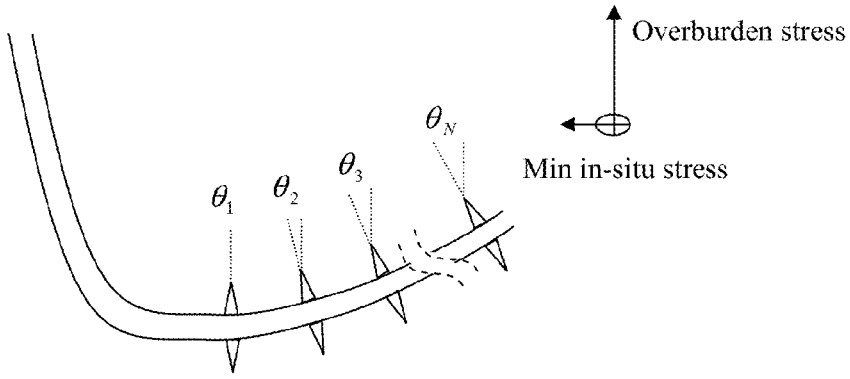
FIG. 4D is a schematic representation of a side view of a deviated well with a trajectory curved in vertical plane and an ascending toe section showing perforations oriented at different angles (0) relative to overburden (maximum principal in-situ) stress.

The orientation of such a propellant pre-fracture plane relative to the principle stresses is determined by its position along the curved wellbore trajectory as shown in FIGS. 4A, 4C and 4D. Anisotropy between principal stresses provides differences in the pressure required for further propagation of differently oriented propellant pre-fractures. For instance, in a horizontal portion of the wellbore with the trajectory curved in the horizontal plane, as shown in FIGS. 4A-4B, the increase of the angle between the plane of the propellant pre-fracture and the direction of maximum horizontal stress causes the corresponding increase in pressure required for its further propagation (PFPP). The differences in the horizontal stresses in wells with curved trajectories in the horizontal plane results in the dependence of the FCP and PFPP on a position of the fracture initiation point along the wellbore.

Figure 4E:
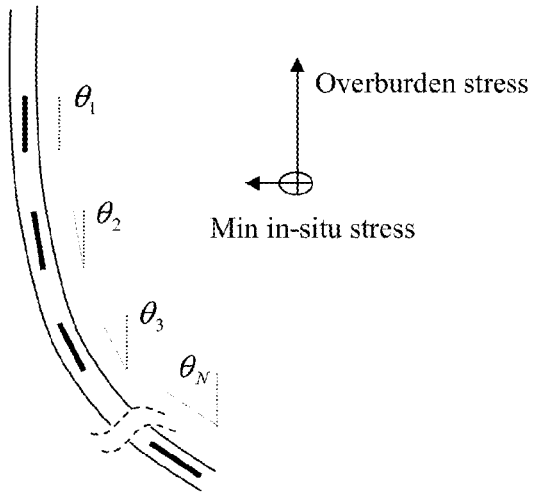
FIG. 4E is a schematic representation of a side view of a deviated wellbore with a trajectory curved in vertical plane showing clusters of perforations located along the wellbore axis and oriented in the direction of maximum principal horizontal in-situ stress.
Figure 4F:
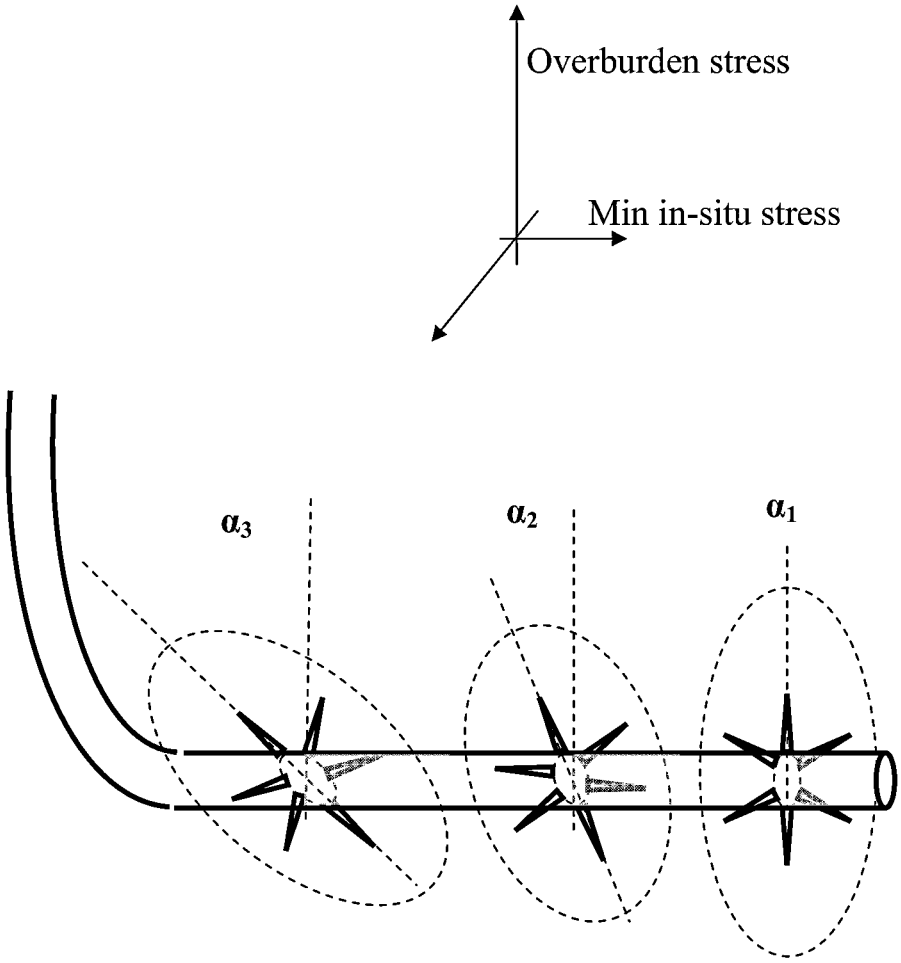
FIG. 4F is a schematic representation of a side view of a horizontal section of a cased wellbore showing perforation clusters oriented at different angles (a) relative to overburden (maximum principal in-situ) stress.

The orientation of such propellant pre-fracture planes relative to the principle stresses may also be determined by the position of the perforations before the propellant treatment, as shown in FIG. 4F. In this figure the increase of the angle between the plane of the propellant pre-fracture and the direction of maximum (overburden) stress causes the corresponding increase in pressure required for its further propagation (PFPP).

Once the principal stresses surrounding the wellbore are determined in the zone or zones to be treated, a perforating system can be configured to provide the proper flow-through passage orientation or perforation entry characteristics. If an appropriate perforation strategy is the creation of specifically oriented perforations then this may be accomplished by using oriented perforating techniques. Such technology enables the perforating of the wellbore casing at selected angles toward one of the principal stresses. Various methods of orienting perforating tools in wellbores are known. Orienting perforating charges in a wellbore may be achieved by mechanical rotary systems, by applying magnetic positioning devise (MPD) or by using gravity based methods. Suitable tools for perforating may include tubing conveyed perforating (TCP) guns that utilize orienting spacers, oriented jetting systems, mechanical tools for drilling or cutting casing walls, oriented laser systems, etc. Non-limiting examples of oriented perforating systems and methods include those described in U.S. Pat. Nos. 6,173,773 and 6,508,307 and U.S. Patent App. Pub. Nos. US2009/0166035 and US2004/0144539, each of which is incorporated herein by reference in its entirety. An example of a commercially available oriented perforating system is that available as OrientXact™ perforating system, from Schlumberger Technology Corporation, Sugar Land, Tex., which is a tubing conveyed oriented perforating system.

The flow-through passages or perforations in each zone may utilize 0° or approximately 180° phasing with the density of 4 shots per foot or more. A cluster of perforations may be provided in each zone with substantially the same orientation and charge phasing or the perforations may be oriented with a perforation angle of less than ±5° from one another within the same cluster. The flow-through passage(s) or perforation(s) that is oriented at an angle closest to the direction or plane that is parallel to the direction of a maximum principal stress may be referred to as the "minimal angle" for that particular cluster or zone. By its definition the minimal angle is greater than or equal to zero and is less than of equal to 90°. There may be from 1 to 500 perforations provided in each cluster, more particularly from about 10 to 20. The length of each perforation cluster may range from about 0.1 to 200 meters, more particularly from about 0.5 to 5 meters. The distance between clusters may range from about 5 to 500 meters, more particularly from about 10 to 150 meters. Of course, the spacing, number of perforations, etc. will depend upon the individual characteristics of each well and the zones being treated. The differences in the flow-through passage or perforation angles between each treated zone will typically vary at least ±5° or ±10° from zone to zone. The minimal angle of each zone may differ from the minimal angle of other zones by 5° or more. In certain cases the differences in the angles from zone to zone may vary from ±15°, ±20°, ±25°, ±30° or more. The difference in perforation angles from zone to zone, however, may depend upon the formation type and formation stresses surrounding the wellbore that provide the desired differences in fracture closure pressure.

Typically, the flow-through passages or perforations are oriented so that the perforated zone with the lowest fracture closure pressure is in a toe position of the wellbore, with the remaining zones extending toward the heel position, so that the formation is treated toe to heel of the wellbore. Of course, the perforated zones may be configured so that the lower fracture closure pressure is located in the heel, with the fracturing treatment being carried out heel to toe.

In the present invention, a propellant pre-fracturing treatment is conducted in the perforated zones, thereby extending the perforations. The use of propellant fracturing creates radial fractures that extend the flow-through passages or perforations and penetrate the formation up to several meters. The propellant fracturing treatment may be conducted subsequent to perforating the wellbore or may be combined with the perforating treatment wherein the propellant is ignited immediately after or simultaneously with the charges used in forming the perforations. In propellant fracturing, a propellant assembly that includes a body of propellant, which is typically shaped as a cylinder, is positioned within the wellbore and is detonated with a detonating cord or other detonator to ignite the propellant. In certain instances, the propellant is combined with shaped charges for forming the perforations, with the detonation of the shaped charges and propellant occurring substantially simultaneously. Non-limiting examples of various propellant systems and methods for creating propellant fractures are described in U.S. Pat. Nos. 4,039,030; 5,295,545; 5,551,344; 6,336,506; 7,059,411, 7,284,612 and 7,431,075, each of which is incorporated herein by reference. Propellant fracturing assemblies that include perforating systems or charges for providing perforations are configured to provide the required perforation orientation or phasing as previously discussed. In certain embodiments, certain zones may only be perforated with no propellant pre-fracturing. Those zones that have not been propellant fractured may have higher fracture initiation pressures.

After the propellant pre-fracturing is conducted, the multi-zone fracturing treatment wherein a fracturing fluid is introduced into the wellbore to fracture the formation is carried out. To carry out the multi-zone fracturing treatment in accordance with the invention, the bottomhole fluid pressure during the fracturing treatment is controlled so that it is maintained below the pre-fracture propagation pressure of each subsequent perforated and pre-fractured zone to be treated. This corresponds to the situation represented by Formula (1) below:

$$PFPP_1 < PFPP_2 < \ldots < PFPP_{N-1} < PFPP_N \quad (1)$$

where N is the total number of zones being treated in the fracturing operation. In the case of the first zone to be treated, the pre-fracture propagation pressure $PFPP_1$ is lower than the pre-fracture propagation pressure in all the other zones to be fractured in the fracturing operation. These differences in pre-fracture propagation pressure are due to the orientation of the perforations and, that means, propellant pre-fractures in each zone in relation to the principal stresses surrounding the wellbore, as previously described. Introducing fracturing fluids at pressures or rates so that the pressure is at or above $PFPP_1$ but below the other pre-fracture propagation pressures of the remaining zones (i.e. zones 2 to N) facilitates the multi-stage fracturing treatment. Likewise, in the second zone to be treated, the pressure is increased to at or above pre-fracture propagation pressure $PFPP_2$ of the second zone to be fractured. The fracturing pressure for the second zone is less than the pre-fracture propagation pressure of the remaining untreated zones (i.e. zones 3 to N). The pressure of fracturing fluid pumped is sequentially increased for each zone until all the zones have been sequentially fractured.

The fractured zones are isolated prior to increasing the fracturing fluid pressure to fracture the next zone to be fractured with utilizing of an incremental pressure buildup (stresscage effect) when the fracture is closed on proppant placed inside, or with other isolation techniques, or with the combination of the mentioned approaches. Various isolation techniques may be employed that are well known in the art. This may include the use of various mechanical tools, ball sealers, diversion with particulate material, bridge plugs, flow-through bridge plugs, sand plugs, fibers, particulate material, diversion with viscous fluids and foams, etc., and combinations of these. A proppant plug can be formed in the fracture by increasing the proppant concentration to the level required for bridging of the fracture or by including bridging agents in the proppant slurry. In the latter case, shut-down or reduced pumping rate may be utilized to facilitate fracture closure. In one particular embodiment of the invention, after the propellant pre-fractures are formed, proppant plugs may be created in the fractures during the fluid fracturing treatment as a possible method of isolating the treated zones followed by allowing the fracture to close on the treated zone. In this case, the fracturing fluid may be redirected to other zones at least in part due to the stress-cage effect developed in the previously treated region or zone. This effect results in the increase in fracture propagation pressure in the zone were the proppant plug was placed and prevents the fracture from re-opening and forcing to propagate.

Figure 2:
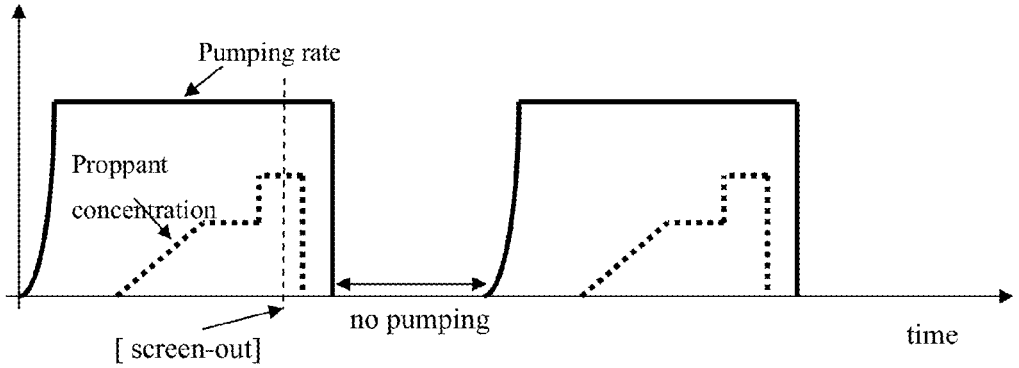
FIG. 2 is a plot of a pumping cycle used to close created fractures to create incremental pressure buildup.

Creating a proppant plug in a fracture can be accomplished by significantly increasing the proppant concentration during the final phase of each pumping cycle, as is illustrated in FIG. 2. Between each cycle the pumping is stopped or reduced to a level wherein the fracture closes. After the fracture closes, the pressure required to re-open the fracture and force it to propagate may exceed the pre-fracture propagation pressure of the next zone to be treated. Thus, the pre-fracture in the next zone starts developing without propagating the fracture(s) in the previous fractured zone or zones.

To ensure that the fractures from the fluid fracturing treatment are created sequentially within the multiple zones, two conditions should be met. The first condition requires that 1) a new fracture be started without letting the previous fracture propagate, as previously discussed. The second condition is that 2) only fractures within a single zone are developed at each moment during the treatment.

To facilitate a further understanding of this particular zone isolation method, the nomenclature set forth in Table 1 is used:

TABLE 1

| |
|---|
| FIP = Fracture Initiation Pressure (new fracture) |
| FPP = Fracture Propagation Pressure (existing fracture) |
| FBR = Formation Breakdown Pressure |
| FCP = Fracture Closure Pressure (existing fracture) |
| PFPP = Pre-Fracture Propagation Pressure |
| BIP = Bridging Incremental Pressure (proppant, plug, etc) |
| n = index of $n^{th}$ fracture |
| $\sigma_v$ = vertical in-situ stress |
| $\sigma_h$ = minimum principal horizontal stress |
| $\sigma_H$ = maximum principal horizontal stress |
| $T_s$ = tensile rock strength |
| $P_P$ = pore pressure |

To satisfy the first condition, the following condition of Formula (2) must be true:

$$FIP^n<FPP^{n-1}; \ldots ;FIP^n<FPP^1 \quad (2)$$

Here $FIP^n$ is the pressure required for the initiation of the new $n^{th}$ fracture, $FPP^k$ is the pressure required for the propagation of the $k^{th}$ fracture (k takes the values from 1 to n−1 in Formula 2 above). In a conventional hydraulic fracturing treatment (without using propellant pre-fracturing treatment), FIP is equal to the formation breakdown pressure (FBP). It is well known for those skilled in the art that in the majority of cases the FPP is lower than the FBP. So the first condition is usually not satisfied. In conventional hydraulic fracturing treatment this can be avoided by having only one zone perforated at a time which requires multiple runs of perforation guns for treating multiple zones within the formation, With using the propellant pre-fracturing treatment, the FIP in Formula (2) is replaced by pre-fracture propagation pressure (PFPP), which can be significantly reduced as compared to the FIP. The result of the propellant pre-fracturing treatment may depend upon the size of the charge and the rate of burning. When using medium-sized charges with more moderate rates of burning, the propellant pre-fracturing treatment may create fractures up to a few meters long that start from the perforations. After the propellant pre-fracturing, these propellant pre-fractures may close completely or they can be partially opened due to the roughness of the fracture surfaces and shear displacement. The pressure required for opening and future propagation of the pre-fractures (PFPP) depends on the orientation of the pre-fractures relative to the directions of principal remote in-situ stress and can be much lower than the FBP. For example, for a non-perforated uncased vertical well the estimated FBP is represented by the Formula (3) below:

$$FBP=3\sigma_h-\sigma_H+T_s-P_p \quad (3)$$

Assuming $T_s$ and $P_p$ are both zero the following exists:

$$FBP=3\sigma_h-\sigma_H \quad (4)$$

To force the pre-fracture to propagate first it is necessary to overcome the stress that acts perpendicular to the plane of the pre-fracture, which is referred to as fracture closure pressure (FCP) herein. With the assumption that Pp=0 and zero fracture toughness of rock, FCP for a fracture in the vertical plane can be estimated as follows:

$$FCP=\sigma_h+(\sigma_H-\sigma_h)\sin^2\theta \quad (5)$$

where θ is the angle between the plane of the pre-fracture and the maximum horizontal principal stress. Then to inject a viscous fracturing fluid into the pre-fracture and continue its propagation some additional pressure is required. With low fluid viscosity and low injection rate, one can assume constant pressure inside the pre-fracture and evaluate this additional pressure dP as follows:

$$dp=K_{Ic}/(\pi L)^{1/2} \quad (6)$$

where $K_{Ic}$ is fracture toughness, and L is the length of the pre-fracture. So the PFPP can be evaluated by Formula (7) below:

$$PFPP=FCP+dP, \quad (7)$$

The second term in Formula (7) is the correction term. For instance, for fracture toughness $K_{Ic}$=1.1 MPa·$m^{1/2}$=160 psi·$m^{1/2}$ and L=2m dP is equal to 64 psi while FCP is usually of two orders of magnitude larger.

From Formulas (4) and (7), it can be seen that in the case of equal horizontal principal stress, and the pre-fracture plane aligned with the direction of maximum horizontal stress (θ=0) the FBP can be twice as high as the PFPP. In the case of stress anisotropy this difference can be less: for example at $\sigma_H/\sigma_h$=1.5 the ratio FBP/PFPP is about 1.5. Stress anisotropy and the presence of perforations can reduce the difference between FBP and PFPP, but in practice during hydraulic fracturing there is almost always a significant pressure peak that corresponds to the moment of formation breakdown. Field observations of this are presented, for instance, in Alberty, M., & McLean, M., A Physical Model for Stress Cages, SPE 90493 (2004), which is incorporated herein by reference.

The potential significant reduction of the pressure required for a new fracture creation, which can be achieved using propellant pre-fracturing treatment leads to the following advantages. 1) It lowers the requirements to isolating previously created fractures using chemical substances or mixtures of substances because there is no need for them to withstand the high pressure difference related to a new fracture creation. 2) It also enables using stress caging effect for the fracture isolation instead of chemically assisted one in high-permeable formations.

One can see from Formulas (5)-(7) that if the pre-fracture is long enough (longer than several wellbore diameters) then the main factors influencing pressure required for pre-fracture propagation (PFPP) are the direction of pre-fracture plane relative to principal remote in-situ stresses, the magnitudes of principal remote in-situ stresses and pore pressure. On the other hand, it is well known for those skilled in the art that the pressure of fracture initiation (FIP) from perforation (without propellant pre-fracturing treatment) is the function of many parameters, which are mainly unknown: local wellbore geometry, local rock properties, perforation geometry and misalignment, local stress state, which is the result of combined effects of remote in-situ stresses, changes of near wellbore stresses during drilling and cementing, pore pressure, poroelastic effects arising during pumping and so on. So one can see that the number of parameters influencing the PFPP is much reduced compared to the FIP. This means that with using propellant pre-treatment the pressure of a new fracture creation is more predictable and controllable as compared to the conventional method of perforating. The better prediction of pressures required for new fractures creation at each stage allows for the improved design and control of the overall multi-stage treatment.

Another advantage of the increased predictability is that in the case of the combination of the propellant pre-treatment with the specifically oriented perforation clusters it is possible to use smaller differences in the angles of orientation between different perforation clusters as compared to the multi-stage treatment where only the specifically oriented perforation clusters are utilized without propellant pre-fracturing treatment. This means that it is possible to design and treat more perforation clusters within one stage of multi-stage treatment (within a single pumping operation). So given the number of perforation clusters to treat the fewer number of pumping operations and runs of equipment downhole is required.

Another advantage of combining propellant pre-treatment with specifically oriented perforation clusters is that it eliminates fracture initiation through the micro-annulus and reduces the near-wellbore fracture tortuosity or pinching in the case of initiation from misaligned perforations, which often accompany high perforation misalignment and can lead to such undesired consequences as an increased treating pressure, premature screen-out and impossibility to complete the fracturing job. This statement in based on the results of the investigations, published in R.G. van de Ketterij, Optimization of the near-wellbore geometry of hydraulic fractures propagating from cased perforated completions, Delft University Press, Delft, the Netherlands, 2001 and in SPE 29573 (J. O. Olson. Fracturing from highly deviated and horizontal wells: numerical analysis of non-planar fracture propagation, 1995).

In one particular embodiment of the invention, by interrupting the pumping cycle and sharply increasing the proppant concentration during the final phase of each pumping cycle, as illustrated in FIG. 2, which allows the developed fracture to close on the proppant near the wellbore, a proppant plug is created. The pressure required to resume propagating of the fracture (i.e. FPP) with the proppant plug inside the fracture can be estimated by Formula (8) below:

$$FPP=FCP+BIP \tag{8}$$

where BIP is the incremental pressure caused by the proppant bridging.

There are two reasons for the resulting BIP. First, the hoop stress around the wellbore is increased because the proppant bridge keeps the fracture open. Second, the permeability of the proppant bridge is limited compared with an open channel without any proppant bridging. The dissipation of the fluid and pressure past the proppant bridge that results during the break in pumping creates a pressure gradient across the bridge. Depending on the permeability of the rock the pressure at the fracture entrance can be therefore considerably higher than the FCP to transfer sufficient pressure load to the fracture surfaces past the bridge to re-open the fracture partially. To resume the fracture propagation it is necessary to therefore increase the wellbore pressure even more.

Thus, instead of the conditions of Formula (2), the following conditions of Formula (9) below are maintained:

$$PFPP^{n}-FCP^{n-1}-BIP^{n-1}<0; \ldots ;PFPP^{n}-FCP^{1}-BIP^{1}<0 \tag{9}$$

where n refers to the $n^{th}$ fracture.

It can be seen from Formula (9) that any increase in the BIP makes the overall multiple zone fracturing treatment more reliable and controllable. The BIP may increase with the growth of the bridge thickness and the reduction in its permeability. To increase the bridge thickness, proppant may be pumped at the maximum permitted concentration at the final phase of each cycle. Alternatively, the treatment may be designed to provide fracture tip screen-out, where this may be appropriate under the reservoir conditions. In certain instances, the permeability of the proppant bridge may be further reduced by filling the spaces between the proppant particles with other materials, such as smaller-size proppant particles, fibers, viscous fluids, polymer fluids, clays and other materials, and mixtures of such materials. Such materials should degrade or be removable after the treatment to prevent damage to the formation or to the fracture permeability.

As previously discussed, other methods of isolating the treated zones may also be used instead or in combination with relying on the incremental pressure (BIP) method developed in the zone after fracture closure.

Figure 3:
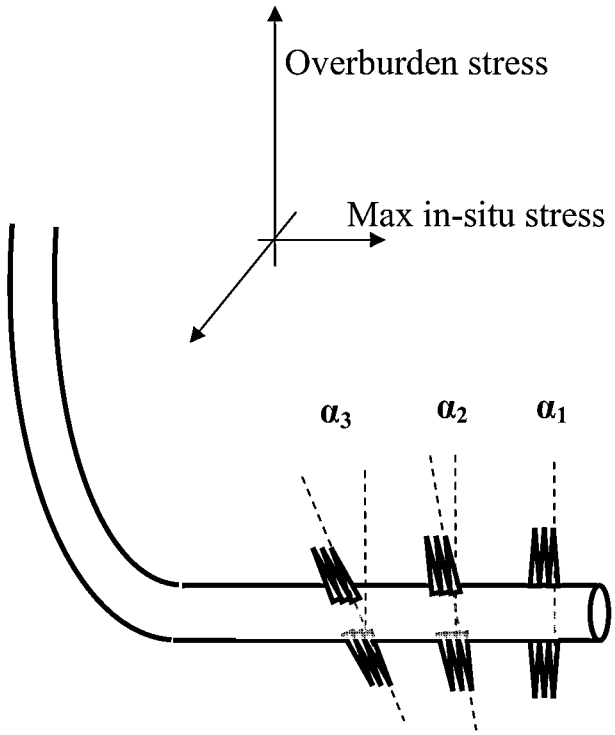
FIG. 3 is a schematic representation of a horizontal section of a cased well drilled showing various perforation clusters oriented at different angles (a) relative to overburden (maximum principal in-situ) stress.

FIG. 3 shows a horizontal section of a cased well drilled in the direction of maximum horizontal stress in a homogeneous formation with a constant fracture gradient. In the first step of the treatment, a few zones in the well are perforated using oriented perforating technology with approximately 180° charge phasing in each zone and with the density of 4 shots per foot or more and forming perforation clusters. The angle $\alpha$ between the perforation channels and the vertical direction is varied from zone to zone, as shown. In this case, the vertical direction represents the overburden or largest principal stress surrounding the wellbore. In the horizontal well section of FIG. 3, the angle $\alpha_1$ in the toe section of the well is minimal so that the fracture closure pressure in this zone is at the lowest level. The angle $\alpha$ then is gradually increased toward the heel. The designed angle of perforation orientation may depend upon the number of intervals being treated. Thus, for example, if there are three zones being treated, the difference in perforation misalignment between different perforation clusters may be 60°/(3−1)=30°. Where there are seven zones being treated, the difference in misalignment may be 60°/(7−1)=10°.

FIGS. 4A-4E illustrate other examples of perforation orientations for multistage fracturing treatments in wells with trajectories curved in horizontal or vertical planes. The multiple zones may be located in a long interval located in one productive layer. The perforation of the interval may be accomplished in one run by the use of a perforating gun, such as tubing-conveyed perforating (TCP) system that may consist of several charge tubes in one carrier. This TCP system provides perforation charge orienting. FIGS. 4A and 4B show wells with a generally horizontal curved trajectory. FIGS. 4C-4E show deviated wells with a curved vertical trajectory. Several perforation clusters may be formed within each of the intervals shown and each interval is fractured in turn. The perforations in each cluster may be oriented at 180° phasing with the perforations in each cluster being shot in the vertical direction as shown in FIG. 4B or in the direction of the maximum horizontal in-situ stress, as shown in FIG. 4E. Another strategy of perforating may be to shoot several perforations with the phasing less than 30° within one cross-section plane that is orthogonal to the wellbore axis as shown in FIGS. 4A, 4C and 4D. Due to the curvature of the wellbore trajectory, the planes of perforations in each perforation cluster are oriented at different angles $\theta_1 \ldots \theta_N$ to the maximum principal in-situ stress, as shown in FIGS. 4A-4E. The choice of appropriate strategy of perforating depends upon the in-situ stress anisotropy in the formation being treated and preferable sequence of zones treatment. In FIGS. 4A-4B, there is a noticeable anisotropy between the horizontal stresses, as shown. In FIGS. 4C-4E, there are noticeable differences between the vertical and horizontal stresses, as shown. In cases presented in FIGS. 4A and 4E, the zones are treated starting from the heel (or top) part of the wells toward the toe (or bottom) part. In FIGS. 4B, 4C and 4D the sequence of zones treatment is opposite: from the toe (or bottom) part of the wellbore to its heel (or top) part.

After or with the perforation treatment, propellant pre-fracturing is conducted, such as with a low-rate burning propellant charge having a sufficient volume to create initial fractures (pre-fractures) of a few meters long. Propellant treatment can be run for each perforation zone separately or for the whole productive interval in one run. This may depend upon the thickness of the productive interval and the available sizes of propellant charges.

By providing oriented perforating followed by propellant pre-fracturing, the pressures of fracture creation (the PFPP) for each single fractured zone are made predictably different. This provides a gradual increase of fracturing fluid pressure required for fracturing each of the several zones, with only the fracture with the lowest PFPP being fractured at a time.

In each case of the embodiments of FIGS. 4A-4E, for instance, the orientation of the perforations and the propellant pre-fracturing assures the creation of the pre-fracture within the perforated zone that will result in the controlled varying of the pressure of fracture creation (the PFPP) from zone to zone. In each case, the fracturing treatment consists of N treatment stages with N−1 isolating stages, which may be implemented in the form of fracture closures for incremental pressure development in between the fracturing of each zone or using other isolating techniques. In the first treatment stage, a fracturing fluid is pumped into the wellbore and the zone with the minimal pre-fracture propagation pressure (PFPP) is fractured or stimulated. The fracturing fluid pressure must be maintained below that of the next lowest PFPP for the remaining non-fractured zones. Isolating is then carried out to isolate the fractured zone using known isolating techniques, such as ball sealers, bridge plugs, sand plugs, particulates, fibers, etc. After isolating, pumping is resumed or continued and the next zone with the next lowest pre-fracture propagation pressure (PFPP) is fractured. This zone is also then isolated if there is at least one untreated zone left. This process is repeated until all zones are subsequently fractured.

Alternatively to the conventional isolating methods, the incremental pressure buildup may be used as an isolating technique, as described. In such cases, the incremental pressure buildup is accomplished by providing a pumping cycle with or without an increase in proppant or bridging material concentration at the end of each pumping cycle, wherein the treated fracture is allowed to close to provide sufficient build-up of BIP to maintain the conditions of Formula (7).

To further illustrate, in a horizontal or highly deviated well with a long interval located in one productive layer several perforation clusters, such as shown in FIG. 3, may be made within this interval, which are each fractured in turn, one by one. There is a noticeable difference between vertical and horizontal stresses. In this situation the appropriate combination of perforating and propellant fracturing strategies may consist of perforating the whole interval in one run of a perforation gun using tubing-conveyed perforating (TCP) system consisted of several charge tubes in one carrier. The TCP-system may allow either the entire gun carrier to rotate or charge tubes to rotate independently. The angle of the rotation may be controllable. There may be no requirement to have an orientation ability (for example, gyroscope) of the TCP-system unless there is a need to realize some preferable order of fracture creation, for example, for some technological reasons there is a need to stimulate the well from toe to heel. Zero or approximately 180-degree charge phasing may be used in each zone.

The perforating gun may be run to the location of the first perforation cluster, a shot is made, and then the gun is moved to the location of the second perforation cluster and rotated to an appropriate angle where a shot is then made. The angle of rotation may depend on the number of clusters and vertical to horizontal stress anisotropy.

The fracturing of the different zones may be conducted while being monitored. Various methods to confirm and identify those zones that are actually being treated in the multistage treatment can be used. For instance, analysis of bottomhole pressure data may be used wherein the level of bottomhole pressure is compared to the created distribution of fracture closure pressure in the perforated intervals. The analysis of the bottomhole pressure profile may also facilitate an understanding of the created fracture geometry. Real-time microseismic diagnostics can be used wherein microseismic events generated during fracturing are registered to provide an understanding of the position and geometry of the fractured zone. This method is well known in the art and is widely used in the oil and gas industry. Real-time temperature logging can also be used. Such methods use distributed temperature sensing that indicates which portion of a wellbore is being treated. Such methods are well known to those skilled in the art and may utilize fiber optics for measuring the temperature profile during treatment. Real-time radioactive logging may be used. This method relies on positioning a radioactive sensor in the wellbore before running a treatment and detecting a signal from radioactive tracers added in the treatment fluid during the job. Analyzing low frequency pressure waves (tubewaves) generated and propagated in the wellbore can also be used. The pressure waves are reflected from fractures, obstacles in the wellbore, completion segments, etc. The decay rates and resonant frequencies of free and forced pressure oscillations are used to determine characteristic impedance and the depth of each reflection in the well, after removing resonances caused by known reflectors.

The multistage fracturing can be used in different formation fracturing treatments. These include hydraulic fracturing with use of propping agents, hydraulic fracturing without use of propping agents, slick-water fracturing and reactive fracturing fluids (e.g. acid and chelating agents). The fracturing fluids and systems used for carrying out the fracturing treatments are typically aqueous fluids. The aqueous fluids used in the treatment fluid may be fresh water, sea water, salt solutions or brines (e.g. 1-2 wt. % KCl), etc. Oil-based or emulsion based fluids may also be used.

In hydraulic fracturing, the aqueous fluids are typically viscosified so that they have sufficient viscosities to carry or suspend proppant materials, increase fracture width, prevent fluid leak off, etc. In order to provide the higher viscosity to the aqueous fracturing fluids, water soluble or hydratable polymers are often added to the fluid. These polymers may include, but are not limited to, guar gums, high-molecular weight polysaccharides composed of mannose and galactose sugars, or guar derivatives such as hydropropyl guar (HPG), carboxymethyl guar (CMG), and carboxymethylhydroxypropyl guar (CMHPG). Cellulose derivatives such as hydroxyethylcellulose (HEC) or hydroxypropylcellulose (HPC) and carboxymethylhydroxyethylcellulose (CMHEC) may also be used. Any useful polymer may be used in either crosslinked form, or without crosslinker in linear form. Xanthan, diutan, and scleroglucan, three biopolymers, have been shown to be useful as viscosifying agents. Synthetic polymers such as, but not limited to, polyacrylamide and polyacrylate polymers and copolymers are used typically for high-temperature applications. Fluids incorporating the polymer may have any suitable viscosity sufficient for carrying out the treatment. Typically, the polymer-containing fluid will have a viscosity value of from about 50 mPa·s or greater at a shear rate of about 100 $s^{-1}$ at treatment temperature, more typically from about 75 mPa·s or greater at a shear rate of about 100 $s^{-1}$, and even more typically from about 100 mPa·s or greater at a shear rate of about 100 $s^{-1}$.

In some embodiments of the invention, a viscoelastic surfactant (VES) is used as the viscosifying agent for the aqueous fluids. The VES may be selected from the group consisting of cationic, anionic, zwitterionic, amphoteric, nonionic and combinations thereof. Some nonlimiting examples are those cited in U.S. Pat. Nos. 6,435,277 and 6,703,352, each of which is incorporated herein by reference. The viscoelastic surfactants, when used alone or in combination, are capable of forming micelles that form a structure in an aqueous environment that contribute to the increased viscosity of the fluid (also referred to as "viscosifying micelles"). These fluids are normally prepared by mixing in appropriate amounts of VES suitable to achieve the desired viscosity. The viscosity of VES fluids may be attributed to the three dimensional structure formed by the components in the fluids. When the concentration of surfactants in a viscoelastic fluid significantly exceeds a critical concentration, and in most cases in the presence of an electrolyte, surfactant molecules aggregate into species such as micelles, which can interact to form a network exhibiting viscous and elastic behavior. Fluids incorporating VES based viscosifiers may have any suitable viscosity for carrying out the treatment. Typically, the VES-containing fluid will have a viscosity value of from about 50 mPa·s or greater at a shear rate of about 100 $s^{-1}$ at treatment temperature, more typically from about 75 mPa·s or greater at a shear rate of about 100 $s^{-1}$, and even more typically from about 100 MPa·s or greater at a shear rate of about 100 $s^{-1}$.

The fluids may also contain a gas component. The gas component may be provided from any suitable gas that forms an energized fluid or foam when introduced into the aqueous medium. See, for example, U.S. Pat. No. 3,937,283 (Blauer et al.), hereinafter incorporated by reference. The gas component may comprise a gas selected from nitrogen, air, argon, carbon dioxide, and any mixtures thereof. Particularly useful are the gas components of nitrogen or carbon dioxide, in any quality readily available. The fluid may contain from about 10% to about 90% volume gas component based upon total fluid volume percent, more particularly from about 20% to about 80% volume gas component based upon total fluid volume percent, and more particularly from about 30% to about 70% volume gas component based upon total fluid volume percent. It should be noted that volume percent for such gases presented herein is based on downhole conditions where downhole pressures impact the gas phase volume.

In hydraulic fracturing applications, an initial pad fluid that contains no proppant may be initially introduced into the wellbore to force the pre-fractures in the treated zone to propagate. This is typically followed by a proppant-containing fluid to facilitate propping of the fractured zone once it is fractured. The proppant particles used may be those that are substantially insoluble in the fluids of the formation. Proppant particles carried by the treatment fluid remain in the fracture created, thus propping the open fracture when the fracturing pressure is released and the well is put into production. Any proppant (gravel) can be used, provided that it is compatible with the base and any bridging-promoting materials if the latter are used, the formation, the fluid, and the desired results of the treatment. Such proppants (gravels) can be natural or synthetic, coated, or contain chemicals; more than one can be used sequentially or in mixtures of different sizes or different materials. Proppants and gravels in the same or different wells or treatments can be the same material and/or the same size as one another and the term "proppant" is intended to include gravel in this discussion. Proppant is selected based on the rock strength, injection pressures, types of injection fluids, or even completion design. The proppant materials may include, but are not limited to, sand, sintered bauxite, glass beads, mica, ceramic materials, naturally occurring materials, or similar materials. Mixtures of proppants can be used as well. Naturally occurring materials may be underived and/or unprocessed naturally occurring materials, as well as materials based on naturally occurring materials that have been processed and/or derived. Suitable examples of naturally occurring particulate materials for use as proppants include, but are not necessarily limited to: ground or crushed shells of nuts such as walnut, coconut, pecan, almond, ivory nut, brazil nut, etc.; ground or crushed seed shells (including fruit pits) of seeds of fruits such as plum, olive, peach, cherry, apricot, etc.; ground or crushed seed shells of other plants such as maize (e.g., corn cobs or corn kernels), etc.; processed wood materials such as those derived from woods such as oak, hickory, walnut, poplar, mahogany, etc., including such woods that have been processed by grinding, chipping, or other form of size degradation, processing, etc. Further information on some of the above-noted compositions thereof may be found in Encyclopedia of Chemical Technology, Edited by Raymond E. Kirk and Donald F. Othmer, Third Edition, John Wiley & Sons, Volume 16, pages 248-273 (entitled "Nuts"), Copyright 1981, which is incorporated herein by reference. In general the proppant used will have an average particle size of from about 0.05 mm to about 5 mm, more particularly, but not limited to typical size ranges of about 0.25-0.43 mm, 0.43-0.85 mm, 0.85-1.18 mm, 1.18-1.70 mm, and 1.70-2.36 mm. Normally the proppant will be present in the carrier fluid in a concentration of from about 0.12 kg proppant added to each liter of carrier fluid to about 3 kg proppant added to each L of carrier fluid, preferably from about 0.12 kg proppant added to each liter of carrier fluid to about 1.5 kg proppant added to each liter of carrier fluid.

Other particulate materials that may be used as diverting agents, such as for providing the incremental pressure buildup (BIP) described herein, may include degradable materials. Degradable particulate materials may include those materials that can be softened, dissolved, reacted or otherwise made to degrade within the well fluids to facilitate their removal. Such materials may be soluble in aqueous fluids or in hydrocarbon fluids. Oil-degradable particulate materials may be used that degrade in the produced fluids. Non-limiting examples of degradable materials may include, without limitation, polyvinyl alcohol, polyethylene terephthalate (PET), polyethylene, dissolvable salts, polysaccharides, waxes, benzoic acid, naphthalene based materials, magnesium oxide, sodium bicarbonate, calcium carbonate, sodium chloride, calcium chloride, ammonium sulfate, soluble resins, and the like, and combinations of these. Particulate material that degrades when mixed with a separate agent that is introduced into the well so that it mixes with and degrades the particulate material may also be used. Degradable particulate materials may also include those that are formed from solid-acid precursor materials. These materials may include polylactic acid (PLA), polyglycolic acid (PGA), carboxylic acid, lactide, glycolide, copolymers of PLA or PGA, and the like, and combinations of these.

In many applications, fibers are used as the particulate material, either alone or in combination with other non-fiber particulate materials. The fibers may be degradable as well and be formed from similar degradable materials as those described previously. Examples of fibrous materials include, but are not necessarily limited to, natural organic fibers, comminuted plant materials, synthetic polymer fibers (by non-limiting example polyester, polyaramide, polyamide, novoloid or a novoloid-type polymer), fibrillated synthetic organic fibers, ceramic fibers, inorganic fibers, metal fibers, metal filaments, carbon fibers, glass fibers, ceramic fibers, natural polymer fibers, and any mixtures thereof. Particularly useful fibers are polyester fibers coated to be highly hydrophilic, such as, but not limited to, DACRON® polyethylene terephthalate (PET) fibers available from Invista Corp., Wichita, Kans., USA, 67220. Other examples of useful fibers include, but are not limited to, polylactic acid polyester fibers, polyglycolic acid polyester fibers, polyvinyl alcohol fibers, and the like.

The thickened or viscosified fluids described, with or without a gas component, may also be used in acid fracturing applications, as well, wherein multiple zones are treated in accordance with the invention. As used herein, acid fracturing may include those fracturing techniques wherein the treatment fluid contains a formation-dissolving material. In such treatments, alternate reactive fluids (aqueous acids, chelants etc) with non-reactive fluids (VES-fluids, polymer-based fluids) may be used during the acid fracturing operations. In carbonate formations, the acid is typically hydrochloric acid, although other acids may be used. In such treatments, the fluids are injected at a pressure above the PFPP of the particular zone of a carbonate (e.g. limestone and dolomite) formation being treated. In acid fracturing a proppant may not be used because the acid causes differential etching in the fractured formation to create flow paths for formation fluids to flow to the wellbore so that propping of the fracture is not necessary. The bridging techniques may or may not be used in acid fracturing to create the incremental pressure buildup (BIP) as further isolating method in acid fracturing.

In slick-water fracturing, which is typically used in low-permeable or "tight" gas-containing formations, such as tight-shale or sand formations, the fluid is a low viscosity fluid (e.g. 1-50 mPa·s), typically water. This may be combined with a friction reducing agent. Typically, polyacrylamides or guar gum are used as the friction-reducing agent. In such treatments, lighter weight and significantly lower amounts of proppant (e.g. 0.012 kg/L to 0.5 kg/L or 1.5 kg/L) than inconventional viscosified fracturing fluids may be used. The proppant used may have a smaller particle size e.g. 0.05 mm to 1.5 mm, more typically 0.05 mm to 1 mm) than those used from conventional fracturing treatments used in oil-bearing formations. Where it is used, the proppant may have a size, amount and density so that it is efficiently carried, dispersed and positioned by the treatment fluid within the formed fractures.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. A method of fracturing a zone within a subterranean formation traversed by a wellbore, comprising:

(a) forming a flow-through passage in two or more zones wherein the flow-through passage is aligned within a single plane, and wherein stresses perpendicular to the planes are different for each of the two or more zones;

(b) generating a pressure pulse to form pre-fractures in each of the two or more zones;

(c) introducing a fracturing fluid into the wellbore in a fracturing treatment;

wherein a pressure of the fracturing fluid in the fracturing treatment forms a fracture and wherein the pressure is above that of the pre-fracture propagation pressure of a pre-fracture within non-treated zones and the pressure of fracturing fluid is lower than the pressure of fracture propagation resumption in all treated zones;

(d) isolating all the fractures within the zone being treated if there is at least one non-treated zone;

(e) repeating (c) and (d) for each pre-fracture within non-treated zones.

2. The method of claim 1, wherein the fracturing fluid contains a proppant.

3. The method of claim 2, wherein the concentration of proppant in the fracturing fluid is increased towards the end the fracturing treatment performed in (c) for at least one of the two or more zones.

4. The method of claim 1, wherein isolation is realized as an incremental pressure buildup (a stress cage) provided by fracture closure on a proppant placed inside the fracture, during the fracturing treatment, the pressure buildup on the proppant occurring during subsequent interruption of pumping or reduction of pumping rate.

5. The method of claim 1, wherein isolating is achieved by the use of mechanical tools, ball sealers, packers, bridge plugs, flow-through bridge plugs, sand plugs, fibers, particulate material, viscous fluid, foams, or combinations of these.

6. The method of claim 1, wherein a degradable material is used for isolating the fractured zone.

7. The method of claim 1, wherein a single plane is parallel to a wellbore axis direction in the area of perforation cluster location.

8. The method of claim 7, wherein the flow-through passages are formed using 0° of 180° phasing with a-density of 4 shots per foot or more.

9. The method of claim 1, wherein the single plane is directed at an angle between 0° and 90° relative to a wellbore axis direction in the area of perforation cluster location.

10. The method of claim 9, wherein the flow-through passages are formed using phasing with the angle more than 0° and less than 30°.

11. The method of claim 1, wherein the flow-through passages are formed by at least one of a perforating gun, by jetting or by forming holes in a casing of the wellbore.

12. The method of claim 1, wherein the two or more zones are located in a portion of the wellbore that is substantially vertical.

13. The method of claim 1, wherein the two or more zones are located in a portion of the wellbore that is curved.

14. The method of claim 1, wherein the two or more zones are located in a portion of the wellbore that is deviated from vertical.

15. The method of claim 1, wherein the two or more zones are located in a portion of the wellbore that is substantially horizontal.

16. The method of claim 1, wherein the stress that acts perpendicular to a cluster plane is different by 100 psi or more from the stress that acts perpendicular to cluster of flow-through passages of any other of the two or more zones.

17. The method of claim 16, wherein the difference of stresses that act perpendicular to cluster planes is provided by orienting the planes of clusters at different angles relative to a selected direction.

18. The method of claim 17, wherein the selected direction is a direction of maximum principal stress of the formation surrounding the wellbore.

19. The method of claim 1, wherein the stress that acts perpendicular to cluster planes within the fractured zone of (e) is less than the stress that acts perpendicular to the planes of clusters of any other non-fractured zones of the two or more zones.

20. The method of claim 1, wherein the zone fractured according to (c) is located towards a toe position of the wellbore and the zone fractured according to (d) is located towards a hell position of the wellbore.

* * * * *